US005873308A

United States Patent [19]

Taira

[11] Patent Number: 5,873,308

[45] Date of Patent: Feb. 23, 1999

[54] STAMP MAKING ASSEMBLY WITH TWO DIRECTIONS OF IRRADIATION

[75] Inventor: Hiroshi Taira, Ichinomiya, Japan

[73] Assignee: Brother Kogyo Kabushiki Kaisha, Nagoya, Japan

[21] Appl. No.: 746,457

[22] Filed: Nov. 12, 1996

[30] Foreign Application Priority Data

Nov. 20, 1995 [JP] Japan ..... 7-325108

[51] Int. Cl.[6] ..... B41K 1/50

[52] U.S. Cl. ..... 101/327; 355/99; 355/101; 399/211; 101/401.1

[58] Field of Search ..... 101/327, 333, 101/368, 379, 401.1, 467; 399/207, 209, 211; 355/67, 71, 78, 85, 99, 101, 121

[56] References Cited

U.S. PATENT DOCUMENTS

| | | | |
|---|---|---|---|
| 3,671,124 | 6/1972 | Amolsch et al. | 355/121 |
| 3,942,440 | 3/1976 | Ritzerfeld | 101/401.1 |
| 4,003,652 | 1/1977 | Allen et al. | 355/101 |
| 4,714,957 | 12/1987 | Takano | 101/401.1 |
| 5,113,225 | 5/1992 | Deguchi | 399/221 |

FOREIGN PATENT DOCUMENTS

| | | |
|---|---|---|
| 2150544 | 4/1995 | Canada . |
| 1 447 253 | 11/1966 | France . |
| 50-31908 | 3/1975 | Japan . |
| 1 115 065 | 5/1968 | United Kingdom . |
| 1 502 299 | 3/1978 | United Kingdom . |
| 2 297 717 | 8/1996 | United Kingdom . |
| WO 95 09730 | 4/1995 | WIPO . |

*Primary Examiner*—Stephen R. Funk
*Attorney, Agent, or Firm*—Oliff & Berridge, PLC

[57] ABSTRACT

A black sheet is interposed between a manuscript and a porous resin and the manuscript face is irradiated by a linear light source moving along the manuscript face under a laminated state. By this process, the total face of the manuscript is irradiated, and a stamp face is formed by heat generation of the black sheet in accordance with a stamp pattern of the manuscript.

23 Claims, 6 Drawing Sheets

STAMP MAKING ASSEMBLY WITH TWO DIRECTIONS OF IRRADIATION

BACKGROUND OF THE INVENTION

1. Field of the Invention

The present invention relates to a method of forming a stamp face and a stamp face forming device for forming a stamp face using porous resin.

2. Description of Related Art

Conventionally, there are known stamps that use porous resin, such as polyurethane or polyethylene, which have continuous pores permitting ink to permeate. A stamp face comprising an ink permeable portion that permits ink to permeate and an ink impermeable portion that prohibits ink from permeating is formed by processing porous resin. According to a stamp having such a stamp face member, ink is previously impregnated in porous resin before stamping by press-contacting the stamp face onto recording paper wherein ink oozes out only from the ink permeable portion where a stamp pattern is formed to transfer an image onto recording paper.

FIG. 10 shows a conventional example of a stamp face forming device for forming the above-mentioned stamp face. According to a conventional stamp face forming device 405, a manuscript 402, a black sheet 404 and a stamp face member 401 formed from porous resin are laminated and held on a glass plane 450 acting as a support member and light is irradiated on the manuscript 402 by a light source 420. A stamp pattern is formed in the manuscript 402 by a portion thereof transmitting light and a portion thereof blocking light. A flash bulb or a stroboscope is used for the light source 420. A reflecting plate 425 is arranged around the light source 420, and light emitted from the light source 420 is reflected toward the manuscript 402.

Instead of using the black sheet 404, a black porous resin plate, which includes light absorbing fine particles, may be used as disclosed in Japanese Unexamined Patent Publication No. 50-31908. In this type of plate, the black porous resin plate itself absorbs light, and heat is generated therein.

Light that has transmitted through the portion of the manuscript 402 is absorbed by the black sheet 404, and heat is generated at the portion of the black sheet 404 receiving the light. The black sheet 404 and the stamp face member 401 are kept in close contact with each other. The portion of the stamp face member 401 in contact with the heat generating portion of the black sheet 401 becomes molten by the heat, thereby suppressing continuous porosity of the stamp face member 401 and forming a thin film layer that does not allow ink to permeate. Light incident on the portion of the manuscript 402 through which light does not transmit does not reach the black sheet 404, and, therefore, heat is not generated at the corresponding portion of the black sheet 404. The corresponding portion of the stamp face member 401 does not melt, thereby forming the ink permeable portion. In this way, the ink permeable portion and the ink impermeable portion are formed on the surface of the stamp face member 401 in accordance with the stamp pattern formed on the manuscript 402.

However, according to the above-mentioned conventional stamp face forming device, the manuscript 402, the black sheet 404 and the stamp face member 401 are mounted above the glass support plane 450. Therefore, when the stamp face is formed by using a manuscript having a comparatively large size, the distance between the light source and the manuscript or the black sheet significantly differs at the peripheral portion of the manuscript and at the central portion thereof. Thus, the amount of irradiated light significantly differs by the position on the manuscript face. That is, the amount of light is comparatively large in the vicinity of the central portion of the manuscript, and the amount of light is comparatively small at the peripheral portion of the manuscript. If the amount of irradiated light is excessively small, the continuous porosity of the stamp face member at the portion to be formed into the ink impermeable portion is not sufficiently suppressed thus permitting ink to permeate, which may form spotted stains during stamping. When the amount of irradiated light is excessively large, even adjacent portions of the stamp face member that are intended to serve as the ink permeable portion melt thereby causing thinned image lines for stamping.

SUMMARY OF THE INVENTION

An object of the present invention is to provide a method for forming a stamp face and stamp face forming device that forms a stamp face that operates without dotted stains or thinning of lines by uniformly irradiating light on a manuscript face.

In order to achieve the above-mentioned and other objects, according to a first aspect of the invention, a surface of a porous resin having continuous pores permitting ink to permeate is heated and selectively melted in accordance with a stamp pattern. This forms a stamp face comprising a thin film layer prohibiting ink to permeate and a stamp pattern portion permitting ink to permeate. A black sheet is interposed between a manuscript, in which a stamp pattern is formed by a portion thereof transmitting light and a portion thereof blocking light, and the porous resin. The manuscript, the black sheet and the porous resin are held in a state where at least the black sheet and the porous resin are brought into close contact with each other and the manuscript face is irradiated by a linear light source moving relatively with respect to the manuscript face. By this, the total face of the manuscript is irradiated, and the stamp face is formed by the heat generation of the black sheet in accordance with the stamp pattern.

Further, the linear light source can be moved in a direction different from the longitudinal direction thereof. Also, it is possible to color the porous resin in black and form a thin film layer by the heat generation of the black porous resin per se. Furthermore, it is possible to further irradiate at least one side face of the porous resin.

According to an aspect of the present invention, a stamp face forming device is provided that selectively heats and melts a surface of a porous resin having continuous porosity in accordance with a stamp pattern. The pattern permits ink to permeate, thereby forming a stamp face comprising a thin film layer prohibiting ink to permeate and a stamp pattern portion permitting ink to permeate. A holding device is provided for interposing a black sheet between a manuscript, in which a stamp pattern is formed by a portion thereof transmitting light and a portion thereof blocking light, and the porous resin. The holding device holds the manuscript, the black sheet and the porous resin in a state where at least the black sheet and the porous resin are kept in close contact with each other. A linear light source irradiates light to the manuscript from a side thereof opposed to a side of the black sheet, and a moving device moves the linear light source relatively with respect to the manuscript face.

Further, when the porous resin is black, the manuscript and the black porous resin may be used by laminating them instead of interposing the black sheet between the manuscript and the porous resin. In this case, a holder is not necessary, so the structure can be further simplified.

Also, the moving device may move the linear light source in any direction. In particular, the direction of the movement of the light source may be different from the longitudinal direction of the linear light source.

The linear light source may be mounted to a housing having a slit. Thereby, parallel light can be irradiated toward the manuscript face via the slit for uniform illumination. Also, a movable shutter member may be provided at the slit of the housing for adjusting the slit width to adjust the amount of light irradiating the manuscript face. Furthermore, a side face irradiating mechanism for irradiating at least one side face of the porous resin may be provided. Incidentally, the side face irradiating mechanism may be a reflecting plate reflecting light from the irradiating mechanism toward at least one side face of the porous resin.

As described above, according to the method of forming a stamp face of a stamp in accordance with the first aspect of the invention, the manuscript face is irradiated by the linear light source moving relatively with respect to the manuscript face. The amount of light irradiated on the manuscript face is made uniform, and spotted ink stains or letter thinning due to nonuniformity of the irradiation of light can be dispensed with.

According to a method of forming a stamp face in another aspect of the invention, the surface of the porous resin can be heated and melted by utilizing the heat generation of the black porous resin. Therefore, a stamp face with no spotted ink stains or letter thinning can be formed by a simple operation without using an additional member, such as the black sheet, for converting light into heat.

In accordance with an additional aspect of the method of the invention, the linear light source is moved in a direction different from the longitudinal direction of the linear light source. Therefore, light can be irradiated on the total face of the manuscript without moving the manuscript and the porous resin plate, whereby the structure of the device is simplified.

Further, in accordance with the present invention, a thin film prohibiting ink to permeate is formed also on the side face of the porous resin plate by irradiating light on the side face of porous resin plate. By this, ridge lines due to oozing of ink from the side face of the porous resin plate are prevented from emerging.

The above-mentioned method of side face irradiating utilizes a reflecting plate reflecting light from the irradiating mechanism toward at least one side face of the porous resin. Therefore, a thin film prohibiting ink to permeate can be formed by irradiating light on the side face of the porous resin utilizing the same linear light source that irradiates light on the manuscript face without the need for another light source.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

An explanation will be given of a stamp face forming device in accordance with the present invention based on the following embodiments.

Figure 2:
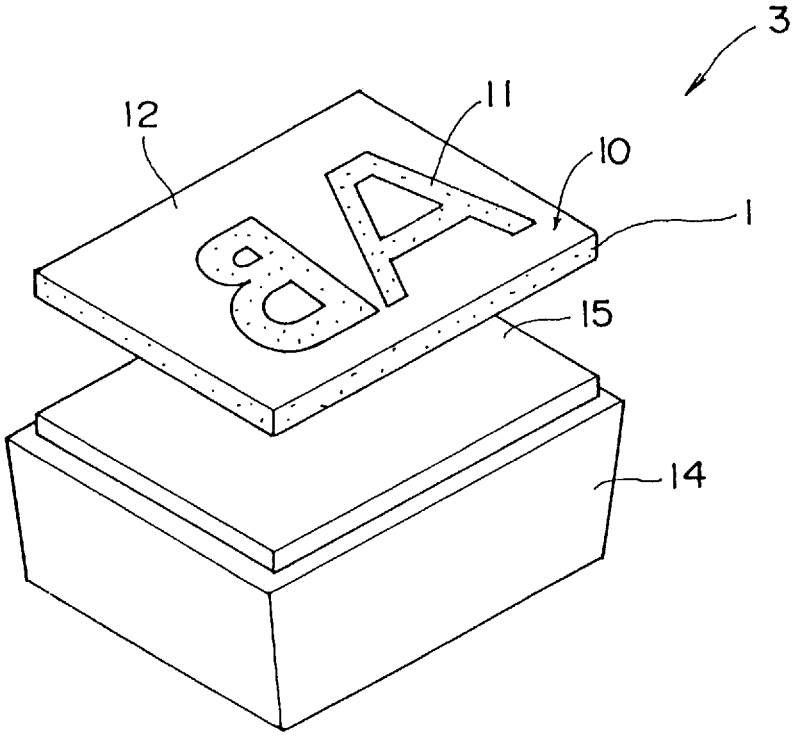
FIG. 2 is a perspective view showing the stamp of the first embodiment.

First, FIG. 2 is a perspective view showing an example of a stamp using a thin plate formed from porous resin as a stamp face member. A stamp 3 is provided with a porous resin plate 1, a grip 14 and an adhesive portion 15 attaching the porous resin plate 1 to the grip 14.

The porous resin plate 1 is a thin plate made of porous resin, such as polyurethane or polyethylene, having fine continuous open cells. The porous resin plate 1 has a property of permitting ink to permeate since it has continuous fine open cells. When the surface of the porous resin plate 1 is heated, the heated portion is melted and the continuous fine open cells are suppressed, thereby forming a thin film layer prohibiting ink to permeate. Accordingly, by heating the surface of the porous resin plate 1 selectively in accordance with a stamp pattern, a stamp face 10 comprising an ink impermeable portion 12, on which a thin film layer is formed by heating as described above, and an ink permeable portion 11, which is not heated and melted whereby the continuous fine open cells remain.

When the stamping is conducted by the stamp 3 using the above-mentioned porous resin 1 as the stamp face member, ink is coated on the stamp face 10 of the porous resin plate 1. Extra ink is wiped off by tissue paper or the like. Ink coated on the ink impermeable portion 12 is wiped off, and ink coated on the ink permeable portion 11 permeates the inside of the porous resin plate 1. When the stamp 3 is pressed on recording paper, ink which has permeated to the inside of the porous resin plate 1 is transferred on paper via the ink permeable portion 11. According to the example of FIG. 2, alphabetical letters of A and B are stamped on a white matrix (a case where white recording paper is used).

Figure 1:
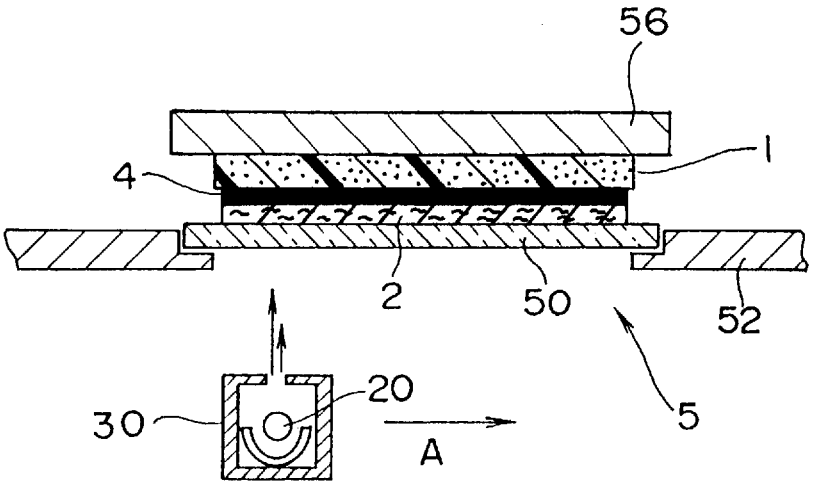
FIG. 1 is a cross sectional side view showing a stamp face forming device of a stamp according to a first embodiment.

FIG. 1 is a cross sectional view showing the basic structure of a stamp face forming device of this embodiment. As illustrated in FIG. 1, according to a stamp face forming device 5, a manuscript 2, a black sheet 4 and a porous resin plate 1 are laminated in this order and held. Light is irradiated onto the manuscript 2 by a light source 20 mounted to a movable unit 30. Further, the manuscript 2, the black sheet 4 and the porous resin plate 1 are mounted on a support glass 50.

Figure 3:
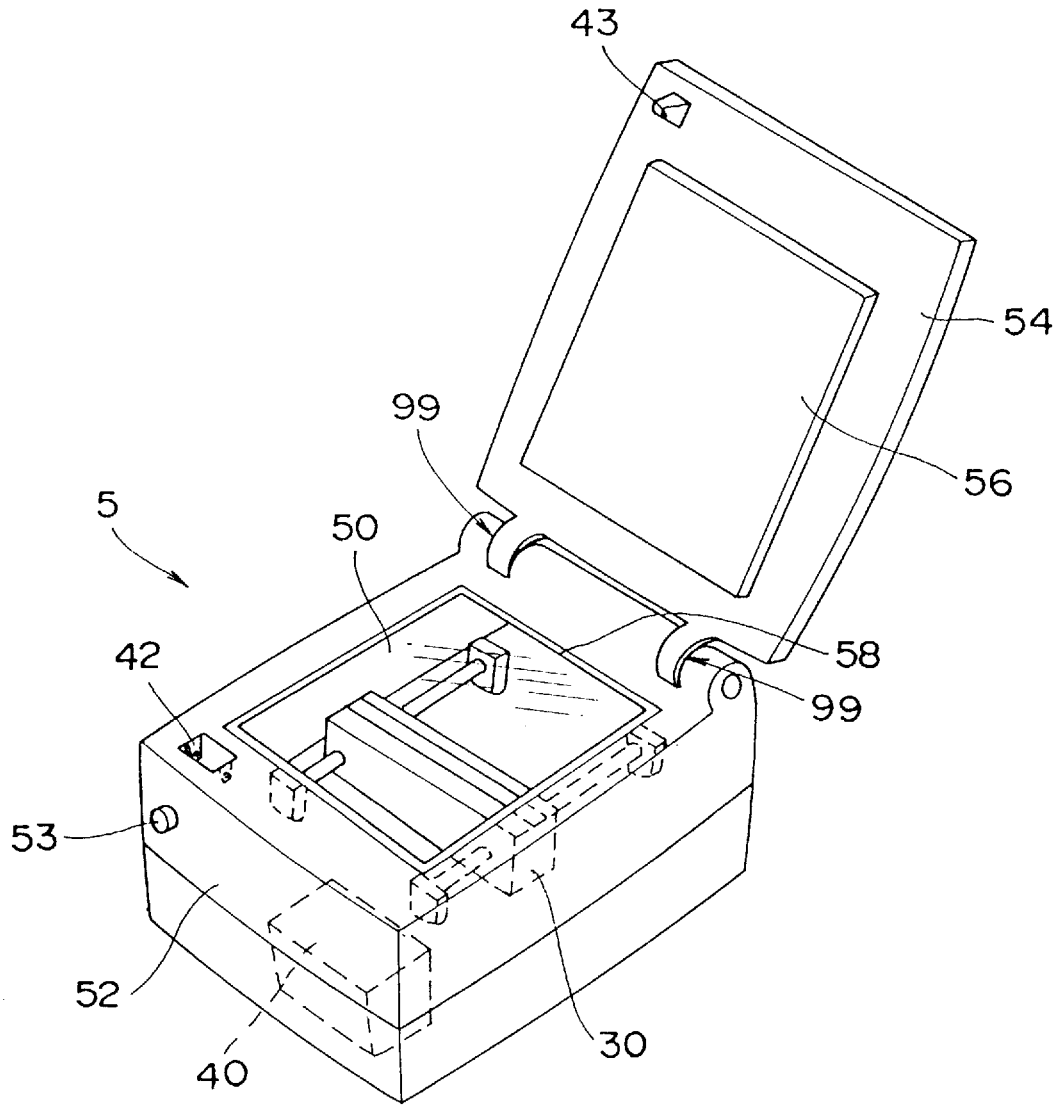
FIG. 3 is a perspective view showing the stamp face forming device of the stamp of FIG. 1.

FIG. 3 is a perspective view showing the stamp face forming device 5. As shown in FIG. 3, the stamp face forming device 5 includes a case 52 and a cover 54 supported by a hinge portion 99 openable with respect to the case 52.

An opening 58 is formed in the case 52. The support glass 50 covering the opening 58 is installed on the upper face of the case 52. The opening 58 is formed larger than a predetermined size of a stamp face (for example, size of a postal card). A retaining member 56, which is disposed above the opening 58 when the cover 54 is closed, is attached to the cover 54.

A controlling unit 40 for driving the movable unit 30 is provided in the case 52. A start switch 53 is provided on a side face of the case 52 and a detection sensor 42 is provided at the upper face of the case 52. The detection sensor 42 detects a projection 43, which is provided on the cover 54 when the cover 54 is closed.

Figure 4:
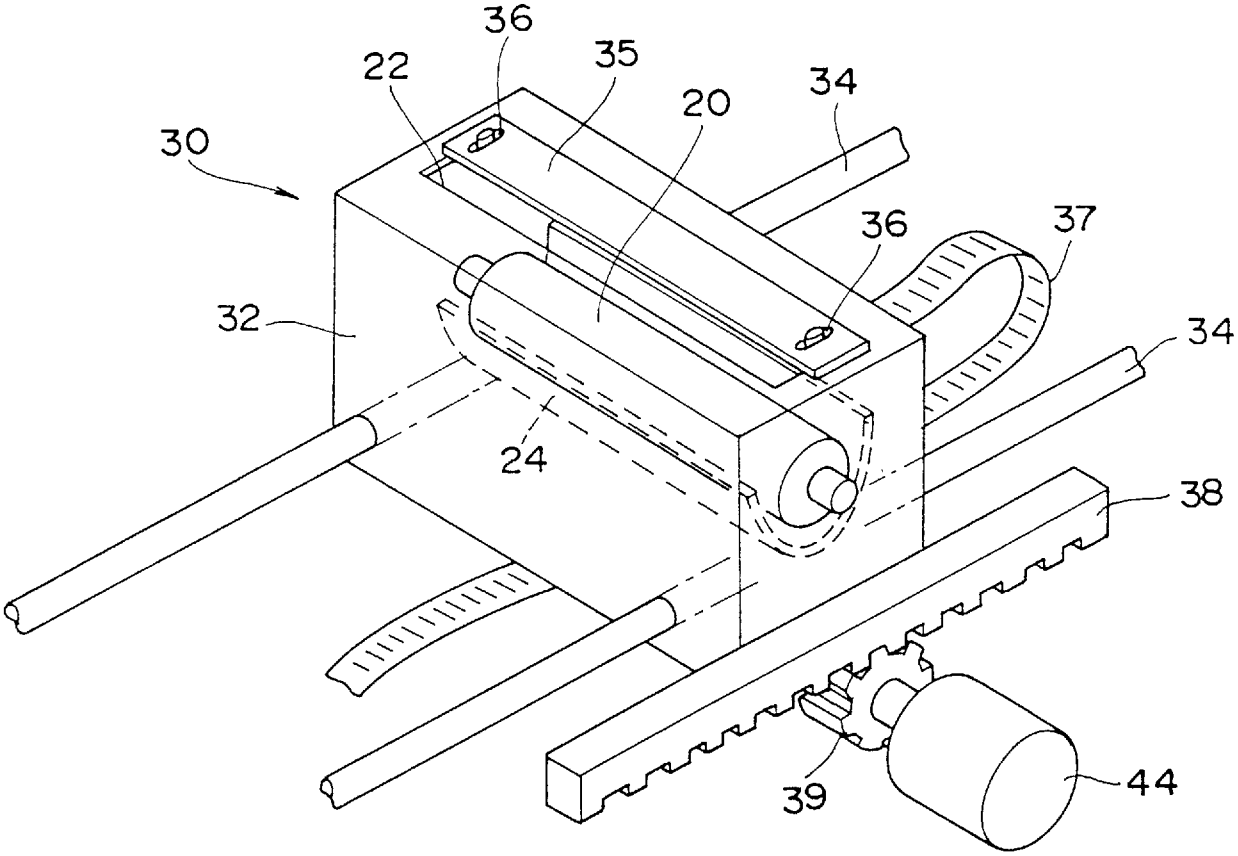
FIG. 4 is a perspective view showing a movable unit of the stamp face forming device of the stamp of FIG. 3.

FIG. 4 is a perspective view showing the movable unit 30. According to the movable unit 30, a linear light source 20, for example, a halogen lamp, is mounted in a housing 32. Both ends of the linear light source 20 are supported by bearings provided in the housing 32. The movable unit 30 and the above-mentioned control unit 40 are connected by a cable 37. A slit 22 in parallel with the linear light source 20 is formed at a portion of the housing 32 right above the linear light source 20.

A reflecting mirror 24 having a U-like sectional shape (parabolic shape) is provided on the side opposed to the slit 22 with respect to the linear light source 20. The reflecting mirror 24 extends in parallel with the linear light source 20 and has a U shape bent around the linear light source 20. The reflecting mirror 24 is formed in a shape whereby light from the linear light source 20 is irradiated from the slit 22 as parallel light.

A shutter 35 for adjusting the slit width is installed on the housing 32. The shutter 35 is provided with elongated slots 36 for attachment that are elongated in the width direction of the slit 22. Thus, the attaching position of the shutter 35 is adjustable in the width direction of the slit 22 so that the width of the slit 22 can be adjusted to a predetermined width. According to this embodiment, the movable unit 30 moves at a constant speed. Therefore, when the width of the slit 22 is excessively small, a portion of the porous resin plate 1 to be melted may not be sufficiently melted. When the width of the slit 22 is excessively large, the portion thereof to form the ink permeable portion may become partially melted to thereby unintentionally form an ink impermeable portion. Therefore, the amount of irradiated light to the manuscript 2 can be adjusted by adjusting the width of the slit 22.

Two guide bars 34 extend at the lower portion of the movable unit 30 in a direction orthogonal to the longitudinal direction of the linear light source 20. Also, a rack 38 in parallel with the guide bars 34 is fixed to the housing 32 on one end side in the axial direction of the linear light source 20. A pinion 39 meshes with the rack 38. The pinion 39 is fixed to an output shaft of a motor 44 installed in the case 52. Accordingly, the movable unit 30 is moved along the guide bars 34 by driving the motor 44.

Next, the operation of the sheet face forming device 5 structured as above is described. A preferable manuscript 2 is one having a stamp pattern in black that does not transmit light on paper such as tracing paper etc. The manuscript 2, the black sheet 4 and the porous resin plate 1 are placed above the support glass 50 in an overlapped state, and the cover 54 is closed. Whereby, the manuscript 2, the black sheet 4 and the porous resin plate 1 are held between the support glass 50 and the retaining member 56. Also, the detection sensor 42 attached to the case 52 detects the projection 43 of the cover 54 when the cover 54 is closed.

When the detection sensor 42 detects the projection 43 of the cover 54, that is, when the cover 54 is closed, the control unit 40 renders operable the start switch 53. When the start switch 53 is pushed, the control unit 40 drives the motor 44 simultaneously with the start of irradiation by the linear light source 20 and moves the movable unit 30 along the manuscript 2 at a constant speed. As illustrated in FIG. 1 the movable unit 30 is moved along the face of the manuscript 2 in an arrow mark A direction while emitting slit light from the linear light source 20.

Light can be irradiated uniformly on the manuscript face since the linear light source 20 extending from one side of the support glass 50 to the opposite side of the support glass 50 irradiates the slit light while moving along the face of the manuscript 2 in this way.

Therefore, defects do not occur such as spotted stains due to insufficient melting or thinning of letters (when letters are written on a white matrix by ink) because of too much melting.

Figure 5:
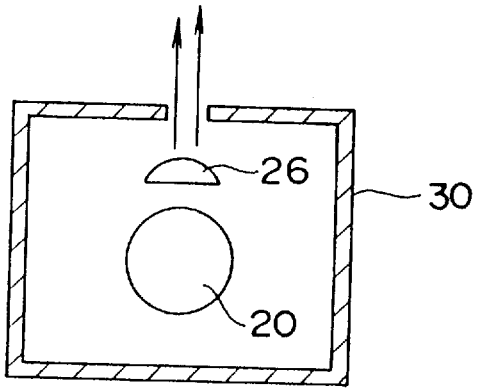
FIG. 5 is a cross sectional side view showing an example in which a cylindrical lens is installed in the movable unit of FIG. 4.

Additionally, as illustrated in FIG. 5, a cylindrical lens 26 may be arranged between the linear light source 20 and the slit 22 to provide parallel light instead of using the reflecting mirror 24. Or, both of the reflecting mirror 24 and the cylindrical lens 24 may be used.

Figure 6:
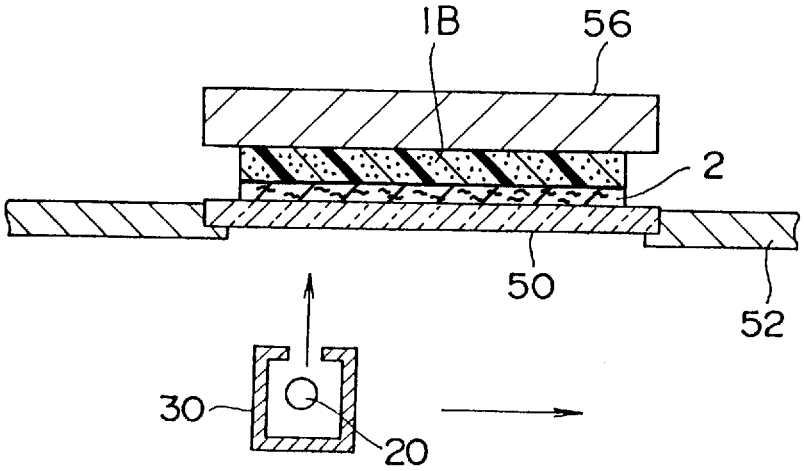
FIG. 6 is a cross sectional side view showing a stamp face forming device of a stamp according to a second embodiment.

FIG. 6 is a view showing a second embodiment. According to the second embodiment, the black sheet is not used, and, instead, a black porous resin plate 1B is used as the stamp face member. In the first embodiment, the black sheet absorbs light so that heat is generated. However, in the second embodiment, the stamp face member per se achieves a function of converting light into heat.

The black porous resin plate 1B is formed by mixing carbon to, for example, polyurethane or polyethylene. The plate includes continuous fine open cells and has the property of permeating ink similar to the porous resin plate 1 in the first embodiment except its color is black.

As shown by FIG. 6 the manuscript 2 and the black porous resin plate 1B are mounted on the support glass 50 of the stamp face forming device 5 by overlapping them. The cover 54 is closed whereby the manuscript 2 and the black porous resin plate 1B are held by the support glass 50 and the retaining member 56. When light is irradiated by the linear light source 20 under this state, light transmitting through the portion of the manuscript 2 that transmits light, irradiates the black porous resin plate 1B. A portion of the black porous resin plate 1B receiving light is heated and melted, whereby continuous fine open cells are suppressed and the ink impermeable portion prohibiting ink to permeate is formed. Light incident on the portion of the manuscript 2 blocking light does not reach the black porous resin plate 1B. The portion of the black porous resin plate 1B not receiving light is not heated thereby forming the ink permeable portion permitting ink to permeate. In this way, the stamp face in which a stamp script pattern is formed by the ink permeable portion and the ink impermeable portion is formed in correspondence with the stamp pattern formed on the manuscript 2.

According to the second embodiment, it is not necessary to use the black sheet, and the stamp face can be formed on the surface of the black porous resin plate 1B by merely setting the manuscript 2 and the black porous resin plate 1B in the stamp face forming device 5 by overlapping them and irradiating light thereon. Whereby, the stamp face forming operation is simplified.

Next, an explanation will be given of a third embodiment. In the first embodiment and the second embodiment, the stamp face is formed by overlapping the manuscript 2, the black sheet 4 and the porous resin plate 1, or the manuscript 2 and the black porous resin plate 1B and by irradiating light on the manuscript face. When the total face of the porous resin plate on which the stamp pattern comprising the ink permeable portion and the ink impermeable portion is formed in this way, ink may ooze out from side faces of the porous resin plate when the stamp is used frequently. Also, when the pressing force of the stamp is large since the porous resin plate per se has the property of permeating ink, ink may ooze from the side faces. When ink oozes out from the side faces of the porous resin plate, ridge lines of the porous resin plate emerge. A third embodiment is carried out to prevent this problem.

Figure 7:
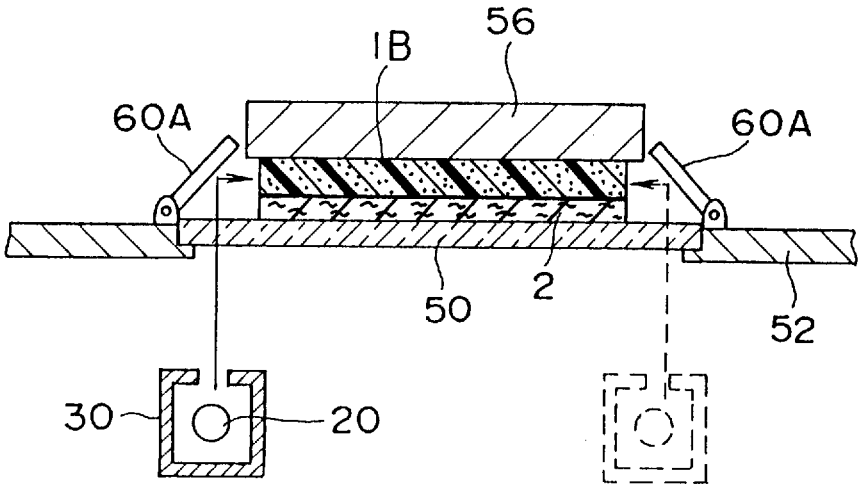
FIG. 7 is a cross sectional side view showing a stamp face forming device of a stamp according to a third embodiment.
Figure 8:
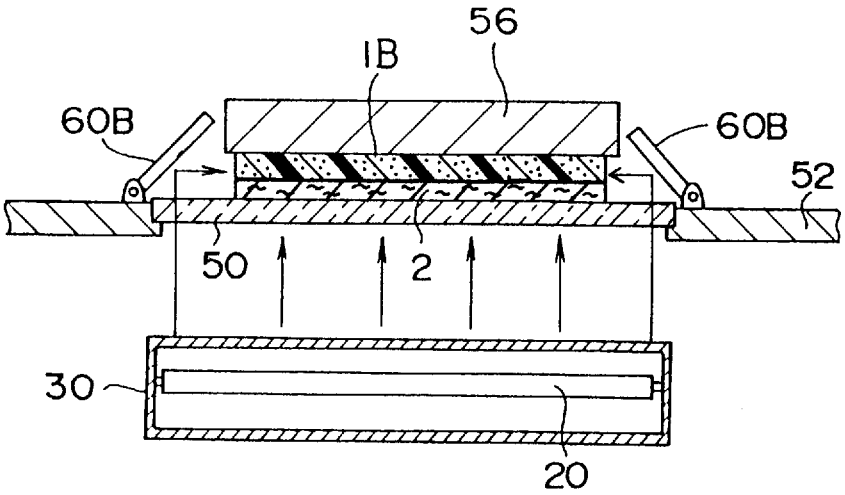
FIG. 8 is a cross sectional side view showing the stamp face forming device of a stamp according to the third embodiment.

FIG. 7 and FIG. 8 are cross sectional views showing a stamp face forming device according to the third embodiment. The black porous resin plate 1B is the same as that in the second embodiment. FIG. 7 is a cross sectional view of the stamp face forming device, and FIG. 8 is a cross sectional view of the stamp face forming device from a front face (in the direction of moving the movable unit). Two reflecting plates 60A and two reflecting plates 60B are installed to surround four side faces of the black porous resin plate 1B. The reflecting plates 60A and the reflecting plates 60B are respectively inclined from the vertical direction by 45°. Light incident on the respective reflecting plates 60A or 60B from right below thereof is irradiated to side faces of the porous resin plate 1B opposed to the reflecting plates. Here, the reflecting plates 60A are reflecting plates extending in a direction the same as the direction of the linear light source 20, and the reflecting plates 60B are reflecting plates extending along the moving direction of the linear light source 20. Each of the reflecting plates 60A and the reflecting plates 60B has a length extending from an end to an opposite end of the support glass 50.

According to the third embodiment, as shown by FIG. 7, the moving distance of the movable unit 30 and the length of the support glass 50 in the moving direction of the movable unit 30 are larger than the length of the face of the manuscript 2 in the moving direction of the movable unit 30 by a predetermined amount. The manuscript 2 and the porous resin plate 1B are mounted substantially at the center of the support glass 50. Therefore, when the irradiation of light by the linear light source 20 is started and the movement of the movable unit 30 is started, as shown by a bold line arrow mark, first, light irradiated by a linear light source 20 is reflected by one of the reflecting plates 60A. The reflected light is irradiated on a side face on the start side (left side in the drawing) in the moving direction of the movable unit 30 of the black porous resin plate 1B. Further, as illustrated in FIG. 7 by a broken line arrow mark, when the movement of the movable unit 30 is finished, light irradiated by the linear light source 20 is reflected by the other of the reflecting plates 60A. Reflected light is irradiated on a side face on the finish side (right side in the drawing) in the moving direction of the movable unit 30.

Meanwhile, as shown by FIG. 8 the lengths of the linear light source 20 and the support glass 50 in the longitudinal direction of the linear light source 20 are also set longer than the lengths of the manuscript 2 and the black porous resin plate 1B in the same direction. When the stamp face is formed, the manuscript 2 and the porous resin plate 1B are mounted substantially at the center of the support glass 50 also in this direction. Accordingly, when light is irradiated on the manuscript 2 (in moving the movable unit 30), light irradiated from both end portions in the longitudinal direction of the linear light source 20 is reflected by the reflecting plates 60B. The reflected light is irradiated on the faces of the black porous resin plate 1B opposed to the reflecting plates 60B.

When light is irradiated on the side faces of the porous resin plate 1B by the reflecting plates 60A and the reflecting plates 60B in this way, the side faces of the porous resin plate 1B are heated and melted to thereby form the ink impermeable layers. According to the third embodiment, also the side faces of the black porous resin plate 1B can be heated and melted simultaneously with the formation of the stamp face by using the light source the same as the linear light source 20 irradiating light on the manuscript face. Therefore, even if the stamping is conducted repeatedly by a stamp utilizing the total face of the porous resin plate 1B as a stamp face as in the stamp 3 illustrated in FIG. 2, ink does not ooze out from the side faces of the black porous resin plate 1B, and ridge lines do not emerge.

Incidentally, the reflecting plates 60A and 60B may be individually arranged to face specific ones of the four side faces of the black porous resin plate 1B.

When the stamp face has already been formed and only the side faces are to be formed into ink non-permeating layers, it is possible to form the ink non-permeating layers only at the side faces of the porous resin plate 1B. This occurs by covering the stamp face by a member that does not generate heat to melt the porous resin plate 1B when light is irradiated thereon. Then, an operation similar to that in the normal forming operation of the stamp face is conducted.

Figure 9:
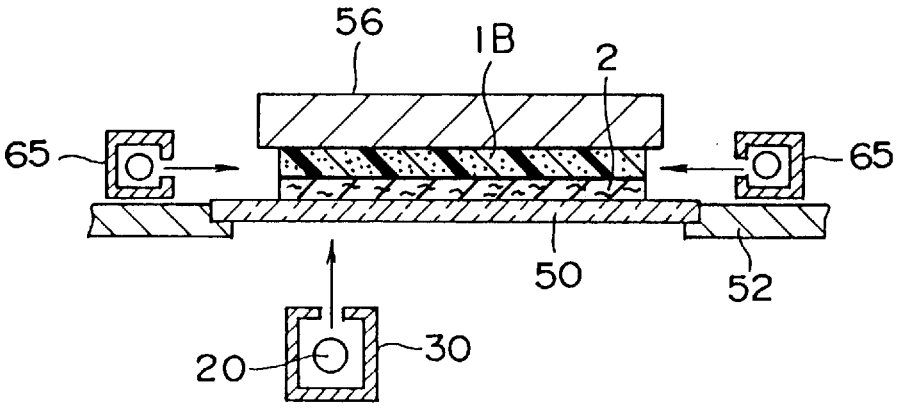
FIG. 9 is a cross sectional side view showing a device in which light sources are installed instead of reflecting plates in the stamp face forming device of FIG. 8.
Figure 10:
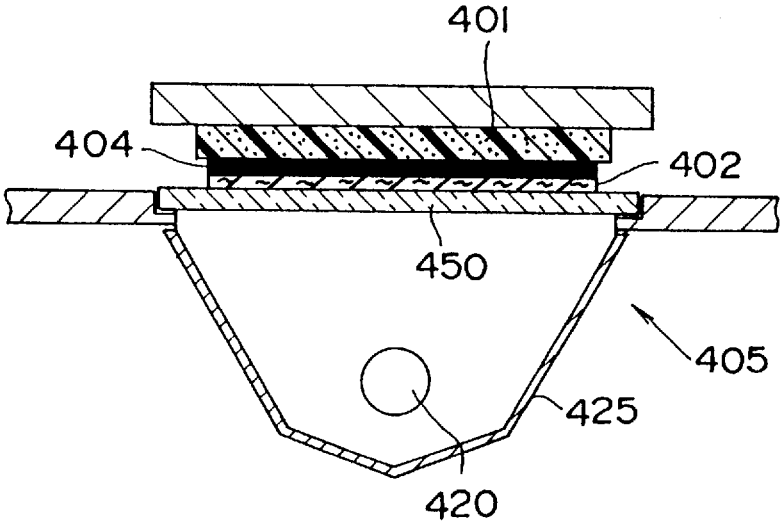
Fig.10 PRIOR ART
FIG. 10 is a cross sectional side view showing a stamp face forming device of prior art.

Further, instead of the reflecting plates 60A and 60B, as illustrated in FIG. 9, side face light sources 65 irradiating light onto predetermined side faces of the black porous resin plate 1B may be provided. In this case, it is possible to form the ink non-permeating layers on all of the side faces of the porous resin plate 1B by repeating the irradiation of light by the side face light sources 65 after changing the direction of the porous resin plate 1B in mounting the plate on the support glass 50.

Additionally, the present invention is not limited to the structures of the above-mentioned embodiments and various modifications thereof are possible. For example, in the third embodiment, instead of the black porous resin plate 1B, a lamination of the black sheet 4 and the porous resin plate 1 in the first embodiment may be used. Still further, although light is irradiated uniformly on the face of the manuscript 2 by moving the linear light source 20 in, the above-mentioned embodiments, the manuscript 2 may be moved instead.

What is claimed is:

1. An assembly for making a stamp from a porous resin plate having a surface and side edges that stamps an image, comprising:

a housing having an interior and a transparent support surface on one side, wherein the transparent support surface is adapted to support the surface of the porous resin plate;

a light source that irradiates the transparent support surface;

a structure that provides irradiation in a direction substantially parallel to the transparent support surface; and a light support assembly supporting the light source.

2. The assembly of claim 1 further comprising:

a drive assembly coupled to the light support assembly for driving the light support assembly with respect to the transparent support surface; and a controller coupled to the light source and the drive assembly for controlling the light source to irradiate and the drive assembly to drive the light support assembly, wherein the light support assembly is mounted for movement in the interior of the housing.

3. The assembly of claim 2 wherein the light source is a linear lamp having a longitudinal axis and the drive assembly drives the light support assembly in a direction perpendicular to the longitudinal axis.

4. The assembly of claim 2 wherein the drive assembly comprises a guide that supports the light support assembly, a rack coupled to the light support assembly, a motor with a drive shaft disposed in the housing, and a pinion attached to the drive shaft of the motor that engages the rack.

5. The assembly of claim 2 wherein the light support assembly comprises a casing unit within which the light source is retained, the casing unit having a slit therein facing the transparent support surface such that light emitted from the light source within the casing unit is directed through the slit and toward the transparent support surface.

6. The assembly of claim 5 wherein the slit is elongated and extends a length at least equal to the transparent support surface.

7. The assembly of claim 5 further comprising an adjustable shutter coupled to the casing unit to selectively cover and uncover the slit to adjust an amount of light that is irradiated from the light source onto the transparent support surface.

8. The assembly of claim 5 further comprising a reflector disposed adjacent the light source that reflects light emitted from the light source toward the slit.

9. The assembly of claim 5 further comprising a lens disposed adjacent the light source that focuses light from the light source toward the slit.

10. The assembly of claim 2 further comprising a retaining member that is configured to hold the porous resin plate onto the transparent support surface.

11. The assembly of claim 10 further comprising a movable cover that selectively covers and uncovers the transparent surface, wherein the retaining member is a portion of the cover.

12. The assembly of claim 11 further comprising a detection sensor supported by the housing and coupled to the controller to detect an open or closed state of the cover and signal the controller to enable driving of the light source.

13. The assembly of claim 2, wherein the structure includes an auxiliary light source coupled to the housing adjacent the transparent support surface, wherein the light source emits light in a first direction toward the transparent support surface and the auxiliary light source emits light in a second direction substantially perpendicular to the first direction in order to irradiate at least one of the side edges of the porous resin plate.

14. The assembly of claim 2, wherein the structure comprises a reflector assembly coupled to the housing and disposed adjacent to the transparent support surface to reflect light from the light source toward at least one of the side edges of the porous resin plate.

15. The assembly of claim 14 wherein the reflector assembly comprises at least one reflecting plate coupled to the housing at at least one edge of the transparent support surface and disposed at about 45° with respect to the transparent support surface so that light emitted from the light source is reflected onto at least one side edge of the porous resin plate.

16. The assembly of claim 2 wherein:

the transparent support surface has two opposed edges, and wherein the drive assembly drives the light support assembly from one of the edges to the other of the edges to fully irradiate the porous resin plate.

17. An assembly for making a stamp from a porous resin plate in combination with a stamp having a surface that stamps an image with ink on a recording medium, comprising:

a housing having an interior and a transparent support surface on one side, wherein the transparent support surface supports a manuscript having the stamping image thereon and the surface of the stamp onto which the image will be formed;

a light source that irradiates the transparent support surface;

a structure that provides irradiation in a direction substantially parallel to the transparent support surface, and a light support assembly supporting the light source, wherein the stamp comprises a porous resin plate having open cells that are ink permeable, and a material that generates heat when irradiated by the light source thereby melting portions of the porous resin plate, suppressing the open cells, and creating an ink impermeable surface that corresponds to the stamping image.

18. The assembly of claim 17 wherein the material of the stamp is a black material.

19. The assembly of claim 18 wherein the black material of the stamp is a black sheet disposed between the manuscript and the porous resin plate.

20. The assembly of claim 18 wherein the black material is carbon mixed in the porous resin plate.

21. The assembly of claim 17 wherein the stamp has side edges formed at least in part by the porous resin plate, and wherein the light source emits light that irradiates the surface of the stamp and the structure reflects light to irradiate at least one side edge of the stamp.

22. The assembly of claim 17 wherein the porous resin plate has side edges and the structure irradiates the side edges to seal the side edges and prevent ink from oozing from non-image portions of the stamp.

23. The assembly of claim 17 further comprising:

a drive assembly coupled to the light support assembly for driving the light support assembly with respect to the transparent support surface; and a controller coupled to the light source and the drive assembly for controlling the light source to irradiate and the drive assembly to drive the light support assembly, wherein the light support assembly is mounted for movement in the interior of the housing.

* * * * *